US007794193B2

(12) United States Patent
Schonauer

(10) Patent No.: US 7,794,193 B2
(45) Date of Patent: Sep. 14, 2010

(54) THREE-SIDE STACKER

(75) Inventor: Michael Schonauer, Moosburg (DE)

(73) Assignee: Jungheinrich Aktiengesellschaft, Hamburg (DE)

( * ) Notice: Subject to any disclaimer, the term of this patent is extended or adjusted under 35 U.S.C. 154(b) by 944 days.

(21) Appl. No.: 11/492,431

(22) Filed: Jul. 25, 2006

(65) Prior Publication Data

US 2007/0041822 A1 Feb. 22, 2007

(30) Foreign Application Priority Data

Jul. 29, 2005 (DE) ..... 10 2005 035 630

(51) Int. Cl.
*B66F 9/14* (2006.01)

(52) U.S. Cl. ..... 414/666

(58) Field of Classification Search ..... 414/627, 414/283, 637, 666

See application file for complete search history.

(56) References Cited

U.S. PATENT DOCUMENTS

| | | | | |
|---|---|---|---|---|
| 3,272,365 | A * | 9/1966 | Stevens | 414/633 |
| 4,470,750 | A | 9/1984 | Vockinger | |
| 5,403,142 | A * | 4/1995 | Stewart | 414/392 |
| 5,599,155 | A * | 2/1997 | Rohm et al. | 414/283 |
| 5,607,189 | A * | 3/1997 | Howeth | 285/39 |
| 5,791,861 | A * | 8/1998 | Seelig | 414/627 |
| 5,797,557 | A * | 8/1998 | Wang et al. | 242/473.6 |
| 5,895,077 | A * | 4/1999 | Sigmundstad | 285/96 |
| 6,109,659 | A * | 8/2000 | Heidenreich et al. | 285/13 |
| 6,412,822 | B1 * | 7/2002 | Omiya et al. | 285/121.3 |
| 7,083,200 | B2 * | 8/2006 | Falconer | 285/121.3 |
| 2001/0046430 | A1 * | 11/2001 | Bayne | 414/408 |
| 2006/0046585 | A1 * | 3/2006 | Harada et al. | 440/84 |

FOREIGN PATENT DOCUMENTS

| | | |
|---|---|---|
| DE | 26 22 792 | 2/1978 |
| DE | 31 41 215 A1 | 4/1983 |
| DE | 30 48 471 | 9/1986 |
| DE | 44 40 604 A1 | 7/1995 |
| DE | 100 13 506 A1 | 10/2001 |
| DE | 100 54 789 A1 | 5/2002 |

* cited by examiner

*Primary Examiner*—Charles A Fox
(74) *Attorney, Agent, or Firm*—Vidas, Arrett & Steinkraus

(57) ABSTRACT

A three-side stacker with a side push frame at one end of the stacker, on which a side arm is horizontally traversable mounted, wherein the side arm has a first traversable portion mounted on the side push frame and a second portion, which is mounted pivotally around a vertical axis on the first portion and on which a load supporting means is mounted, which is actuable by a hydraulic lifting cylinder, and a pivoting equipment for the second portion, mounted on the first portion, wherein the casing of a hydraulic rotational drive with a rotatable spindle is fixed on the first portion, wherein a portion of the spindle is splinedly connected with a holder or a lifting scaffold for the load supporting means outside the casing.

7 Claims, 7 Drawing Sheets

THREE-SIDE STACKER

CROSS-REFERENCE TO RELATED APPLICATIONS

Not applicable.

STATEMENT REGARDING FEDERALLY SPONSORED RESEARCH

Not applicable.

BACKGROUND OF THE INVENTION

Such a three-side stacker has become known from U.S. Pat. No. 4,470,750, the entire contents of which are hereby incorporated by reference in its entirety, for instance. For instance, it is used as a storage rack conveyor. A side push or guide frame is arranged on the front end, transversely to the longitudinal axis of the apparatus. Depending on the type, the side push frame is connected stationarily with the vehicle or guided in the height on a lifting mast or so. Finally, it is also possible to fix the side push frame on the front side of the cab of the vehicle, which is itself as a whole traversable in the height on the lifting mast. In this case, the three-side stacker represents an order picking apparatus. A side arm is horizontally traversable on the side push frame. The side arm consists of two portions, namely a first portion, which is guided on the side push frame, and a second portion, which is mounted to be rotatable around a vertical axis. On the second portion, there is either directly attached a holder for a load supporting means, a fork for instance, or an additional mast, for instance, on which the fork holder can be traversed in the height. With the aid of a drive, which is preferably a hydraulic one, the second portion and with this the load fork or the mast, respectively, can be pivoted around a vertical axis in an angle range of 0 to 180°. The pivoting drive has parallel hydraulic cylinders, which actuate a chain, which is turn wound around a sprocket. The sprocket is splinedly connected with a shaft portion, which is mounted in a rotational bearing of the side arm and is connected with a lifting scaffold. The hydraulic lines for the supply of the drives on the movable parts are integrated and guided in a suitable manner, such that they can follow the horizontal and rotational movement of the side arm or the lifting scaffold, respectively. Toothed racks, arranged parallel in a distance and running horizontally, are attached on the side push frame, with which sprockets or gearwheels on the side arm co-operate. The sprockets or gearwheels sit splinedly on a common torsion shaft, which is in turn driven by a suitable drive. With the aid of this drive, the side arm can be moved horizontally. The torsion shaft provides also stabilisation around an axis parallel to the longitudinal axis of the vehicle.

The rotational drive for the holder for a load receiving means or a mast on the side arm of the side push frame, respectively, requires a high expense for assembly and maintenance, as well as a big number of individual components. In addition, the drive needs a relatively large installation space.

The present invention is based on the objective to improve a three-side stacker of the type mentioned in the beginning, such that the drive for a lifting scaffold or a holder for a load receiving means on the side arm of the side push frame, respectively, needs a smaller number of individual components and requires less expense in the assembly.

BRIEF SUMMARY OF THE INVENTION

In the present invention, the casing of a hydraulic rotational drive is fixed on the first portion of the side arm. The hydraulic rotational drive has a lathe spindle, which stays outside the casing with a portion on which a holder or a lifting scaffold for the load supporting means is splinedly attached. The casing can be attached without problems on that arm of the side arm which is coupled to the side push frame. It is only required to provide the outside positioned portion of the lathe spindle of the hydraulic rotational drive with means for attaching the pivoting body thereon, which is pivotable about an angle of approximately 180°, according to the principle of the three-side reach truck. In the case that the body has a lifting scaffold and also a lifting cylinder for the actuation of the load supporting means along the lifting scaffold, care must also be taken for a hydraulic supply of the lifting cylinder.

According to an embodiment of the present invention, it is provided for this purpose that the rotational drive is realised as a rotary transmission leadthrough for the line of the hydraulic medium towards the lifting cylinder and away from the same, wherein an axial channel in the spindle is in every position of the spindle connected with a stationary hook-up on the casing for the hydraulic medium, and the axial channel is connected with the lifting cylinder. Such a supply of the hydraulic medium avoids the use of a hydraulic tube. As is known, movable tubes are a source of troubles and errors, in particular when the actuated part performs a turning or swivelling movement, respectively.

In a further embodiment of the idea pointed out before, the present invention provides that the spindle of the rotational drive is actuable by a threaded sleeve, which is in turn actuable by a plunger which is guided in the casing of the rotational drive. The channel in the spindle is connected with at least one radial channel in a flange of the spindle, which is sealingly and rotatably mounted in the casing, wherein the radial channel is aligned with an annular channel on the inner side of the casing, which is in connection with the outer hook-up for the hydraulic medium on the outer side of the casing via bore portions. A hydraulic drive of the described kind is per se known. It is only slightly modified so that it can be used as a rotational drive for the pivotable lifting scaffold of a three-side stacker, for instance.

In another embodiment of the present invention, it is provided that a bottom part for the lifting cylinder is connected with the free end of the spindle, on which the envelope of the lifting cylinder is sealingly supported.

In the drive equipment according to the invention for the load supporting means or the lifting scaffold of a three-side stacker, respectively, it is advantageous when the respective turning position can be determined. As a consequence, one embodiment of the present invention provides that a transmitter is connected with the spindle, and an angle sensor is arranged in the casing. Different mechanical or contactless arrangements of sensor and transmitter are conceivable. According to a further embodiment of the present invention, a particularly simple measure is that a gearwheel sits on the spindle, which meshes with a sprocket of a potentiometer.

Several advantages are attained by the present invention. The installation frame for the pivoting drive is extremely small and permits to place the side push frame further downward, through which the visible edge is moved towards the downside and thus it improves the sight on the fork arms. Even in the horizontal direction, a reduction of the installation space is possible. The assembly and the maintenance are improved with respect to conventional drives, not at least by the reduction of the number of the individual parts. A very important advantage is that the force which is exerted by the mast or the load supporting means is directly taken up by the spindle. Through this, the rotational drive is not only a driving means but also a force receiving means.

BRIEF DESCRIPTION OF THE SEVERAL VIEWS OF THE DRAWINGS

The present invention is explained in more detail by means of drawings below.

DETAILED DESCRIPTION OF THE INVENTION

Figure 1:
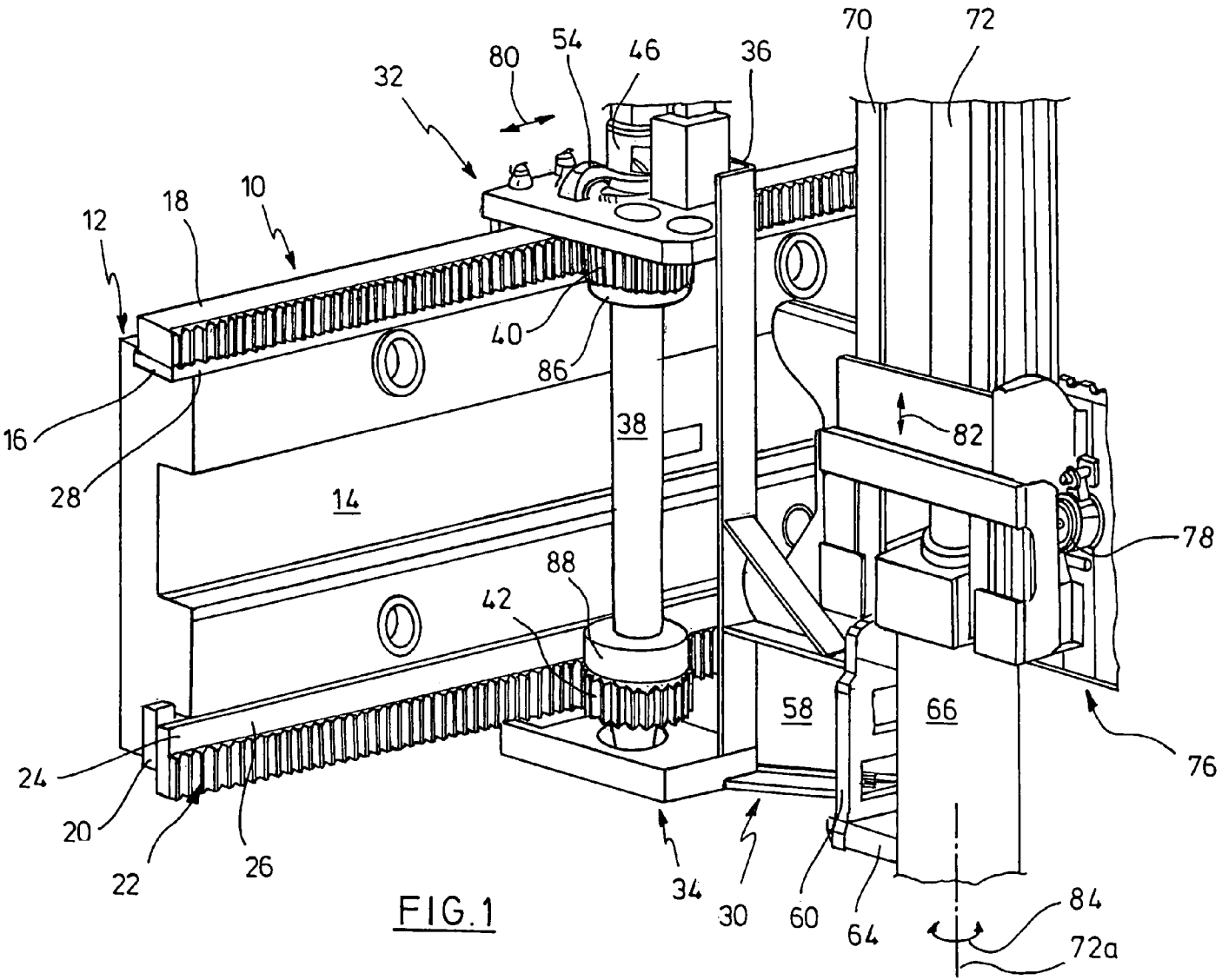
FIG. 1 shows a side push frame with side arm for a three-side stacker according to the invention in a perspective view.

While this invention may be embodied in many different forms, there are described in detail herein a specific preferred embodiment of the invention. This description is an exemplification of the principles of the invention and is not intended to limit the invention to the particular embodiment illustrated In the FIGS. 1 and 2, a side push frame 10 of a three-side stacker is designated with 10. The three-side stacker is not shown for the rest. Insofar, reference is made to U.S. Pat. No. 4,470,750, for instance. The side push frame 10 is fixed horizontally on the front side of the three-side stacker, for instance on the vehicle itself or on a lifting mast or even on a cab, which is height-movably guided on the lifting mast.

The side push frame has a frame profile 12, U-shaped in its cross section, through which a channel 14 is formed. On the upper side of the frame profile 12, a flat rail 16 is fixed. A toothed rack 18 is fixed on the rail 16. Rail 16 and toothed rack 18 run horizontally. A further flat rail is fixed on the lower side of the frame profile 12. A toothed rack 22 is fixed on the rail 20. The toothing of the toothed rack 22 does not extend completely over the width of the rack, instead a slightly retracted portion 24 is provided, which a forms a horizontally extending vertical running path 26. On the side directed towards the toothing of the toothed rack 18, the rail 16 forms also a running path 28. This one too is somewhat retracted against the toothing of the toothed rack 18. The running paths 26, 28 extend in a common plane. However, they can also be in parallel planes. In addition, they run in parallel to the parallel toothed racks 18, 22.

Figure 2:
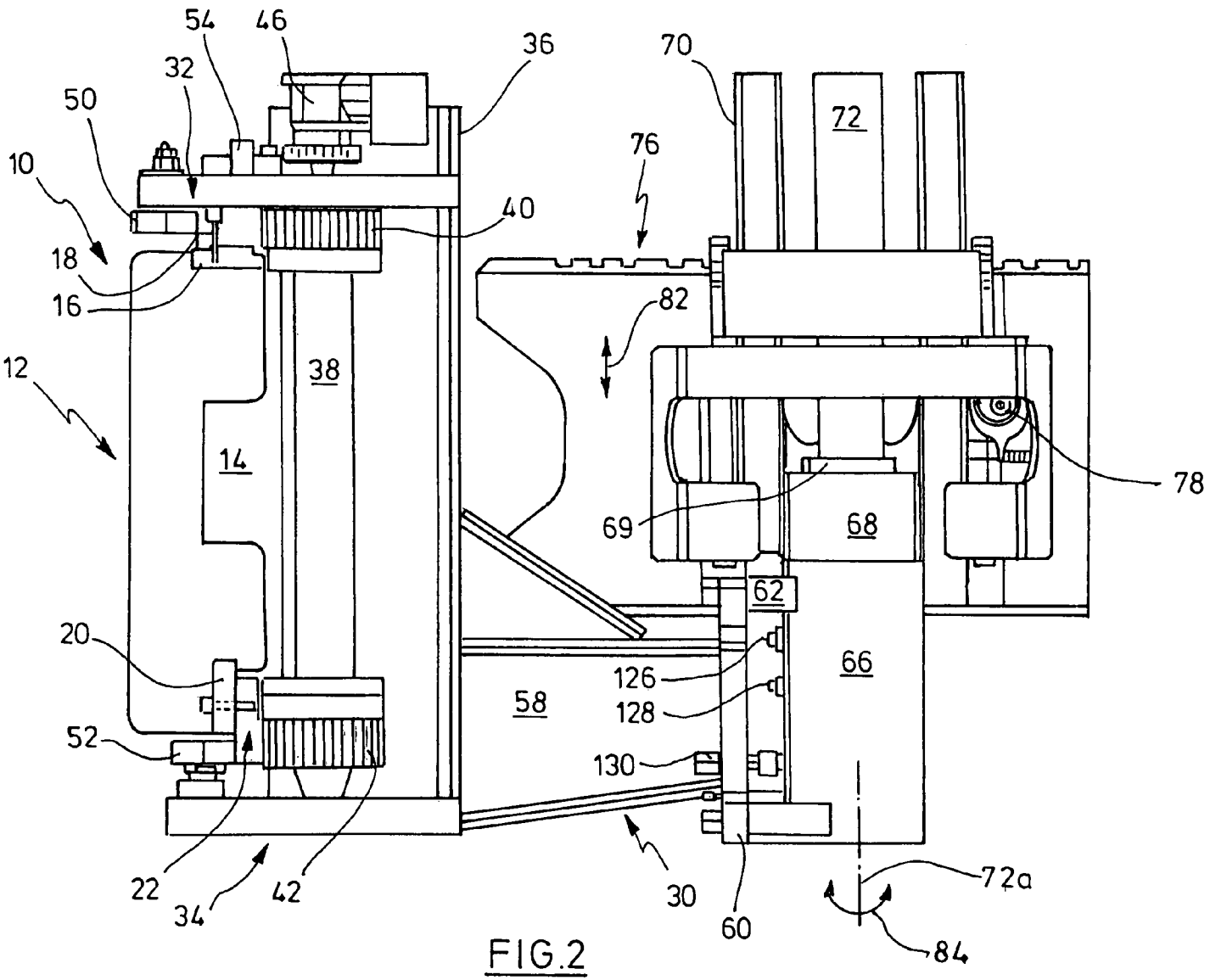
FIG. 2 shows a final view of the representation according to FIG. 1.

A side arm 30, generally extending vertically to the frame profile 12, has an upper mounting plate 32 and a lower mounting plate 34, which are fixed on a stable casing, which is indicated at 36. The mounting plates 32, 34 rotatably bear a torsion shaft 38, on which an upper gearwheel 40 and a lower gearwheel 42 are splinedly arranged. The gearwheels 40, 42 mesh with the toothing of the toothed racks 18, 22. The torsion shaft 38 is rotationally driven by a hydraulic drive 46. On the mounting plate 32, two guide rollers are rotatably mounted around a vertical axis on the lower side, one of which can be recognised at 50 in FIG. 2. The guide rollers 50 co-operate with a guideway of the toothed rack 18, which is on the rear side in FIG. 1. On the lower mounting plate 34, two guide rollers are also rotatably mounted, one of which is shown in FIG. 2 at 52. They co-operate with a guideway on the backside (FIG. 1) of the toothed rack 22. The guide rollers 50, 52 take up the weight momentum of the side arm 30 around an axis parallel to the longitudinal axis of the side push frame 10.

In the mounting plate 32, a further guide roller 54 is rotatably mounted around a horizontal axis. It co-operates with an upper guideway of the toothed rack 18 and takes up the weight force of the side arm. Preferably, two such rolls can also be provided.

An arm 58 is fixed on the casing 36 of the side arm 30, extending horizontally on the lower end, on which a further mounting plate 60 is fixed, which extends transversely. The mounting plate 60 carries a hydraulic rotational drive 66 via an upper arm 62 or a lower arm 64. Via a block 68, its casing supports a lifting mast 70, into which a lifting cylinder 72 is inserted, which is in turn supported on the block 68. With the aid of the rotational drive 66, the lifting mast 70 can be turned around a vertical axis 72*a*, preferably between 0 and 180° or 0 to ±90°. On the lifting mast 70, a sliding cradle or fork carrier 76 is guided in the height, which can be shifted in the height with the aid of a not shown chain and the lifting cylinder 72. Such a lifting drive is commonly known in floor conveyors, and thus it will not be described in more detail. In FIG. 1 or 2, a mounting for a sensor is indicated at 78, by which the lifting height of the sliding cradle 76 is determined.

The supply of hydraulic energy for the drives 46, 66 and the cylinder 72 has naturally to take place from the carrier vehicle, wherein the hydraulic lines are integrated in a corresponding manner (not shown) and are guided through the profile frame 12. They can be guided in a loop (not shown), which is moved in the channel 14, so that the side arm 30 can freely move along the side push frame 10.

As can be further recognised in FIGS. 1 and 2, an upper spacer roller 86 and a lower spacer roller 88 sit on the torsion shaft 38. The spacer roller 86 rolls on a guideway 26, 28. With the aid of the spacer rollers 86, 88, a predetermined distance between the gearwheels 40, 42 and the toothed racks 18, 22 is set.

Figure 3:
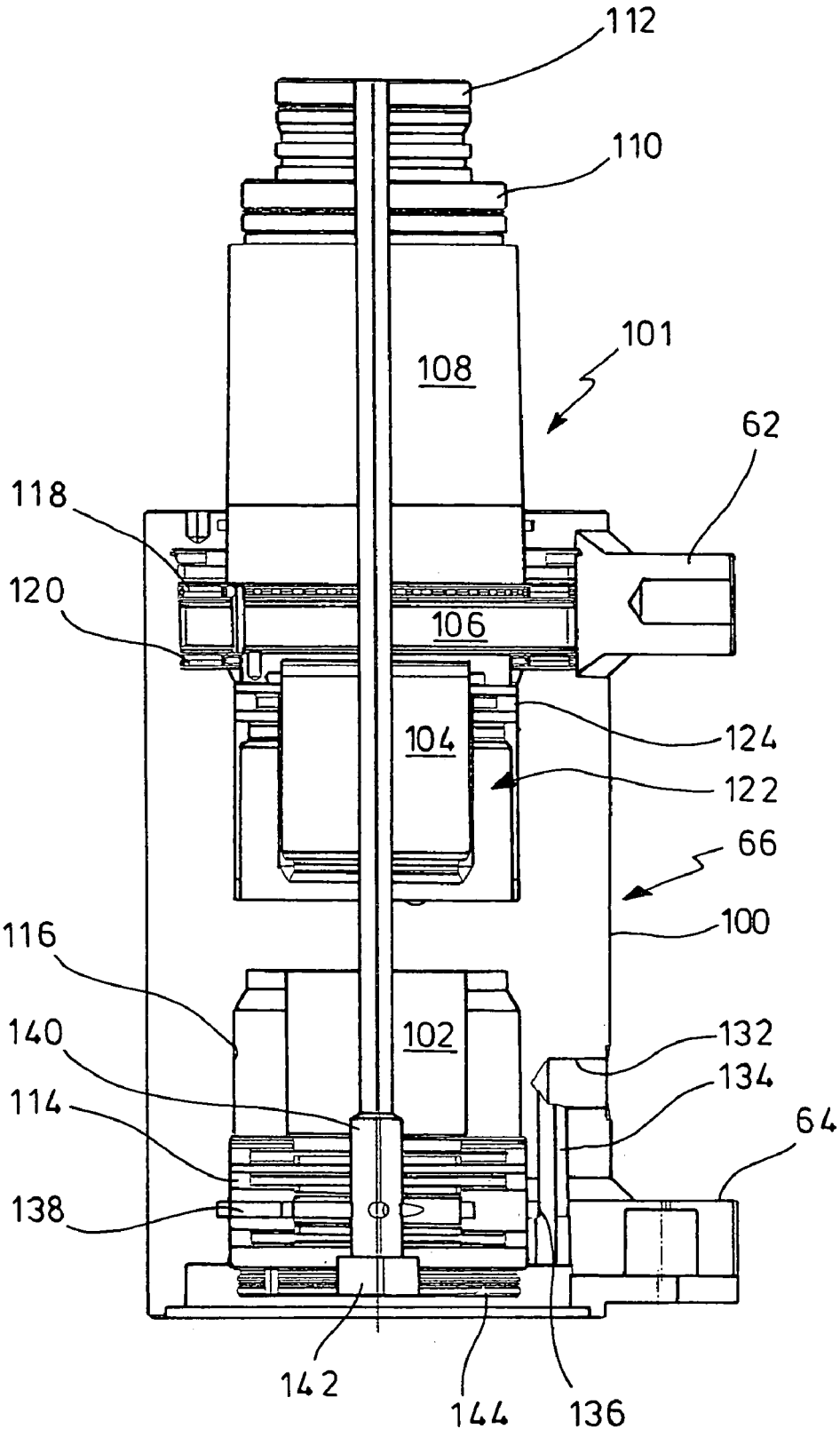
FIG. 3 shows schematically a rotational drive for the arrangement according to FIGS. 1 and 2 in a cross section.

In FIG. 3, the hydraulic rotational drive 66 is shown in some more detail. One recognises a casing 100, which is connected via the lugs 62, 64 with the mounting plate 60, as has already been described. The casing mounts a spindle 101, which consists of the portions 102, 104, 106, 108, 110 and 112. The mentioned portions are either part of a workpiece formed in one part or splinedly connected with each other. A flange 114 is connected with the lower portion 102, which has not shown seals which co-operate with a casing bore 116. The portion 106, provided with a greater radial diameter, is axially mounted in the casing 100 with the aid of an upper and a lower nail bearing 118, 120, so that the spindle is rotatable, but axially stationary. In the casing bore 116, a threaded sleeve 122 is arranged, which is provided with a not shown inner and outer thread, which threads are realised as being relatively steep. The inner thread of the threaded sleeve co-operates with an outer thread (not shown) of the portion 104, and the outer thread of the threaded sleeve 122 co-operates with a thread in the bore 116, wherein the threads are directed contrarily on radially opposing sides of the sleeve. Further, a plunger 124 is connected with the threaded sleeve 122, which can be pressurized with hydraulic fluid from opposing sides.

The hydraulic fluid is fed via hook-ups 126 and 128 (FIG. 2). The lines to the hook-ups 126 and 128 are not shown. As a consequence, the plunger 124 moves in the axial direction upon pressurization, and thus the linear motion of the plunger 124 is transformed into a rotational movement by the threaded sleeve and the spindle. Such a drive is in principle known. Through the co-operation of two pairs of threads, it is possible to produce the desired rotational movement about an angle of 180° and more with a relatively small stroke.

As can be seen from FIG. 2, the casing of the rotational drive 66 has an additional hook-up 130 for hydraulic medium. It is connected with a first bore portion 132 in the casing 100, which is connected with an axis parallel bore portion 134. The vertical axis parallel bore portion 134 is in connection with an annular groove 136 on the inner side of the casing 100. Several radially or beam-shaped, respectively, channels 138 run out into the annular groove 136. The channels 138 run out into an axial channel 140, which extends towards the upside through all the portions of the spindle 101 up to portion 112 inclusively. Towards the downside, the axial channel 140 is closed by a stopper 142. Through this, a rotary transmission leadthrough is provided. The hydraulic medium reaches the rotating spindle from the stationary hook-up 130.

The spindle portion 110 forms a bottom part for the lifting cylinder 72, wherein the portion 112, which is smaller in its diameter, is sealingly inserted into the envelope of the cylinder 72. The ring 69 (FIG. 2) is screwed on the outer thread of portion 110 and thus it fastens the block 68 on the conical portion 108. The mast 70 is fixed on the block 68. The hydraulic medium is directly introduced into the lifting cylinder 72. The spindle portion 108, conical in its upper region and thereafter cylindrical, carries the lifting mast 70, which is not shown in more detail in FIG. 3.

As a consequence, when the hydraulic rotational drive according to FIG. 3 is actuated, the spindle 101 and with it lifting mast 70 and lifting cylinder 72 are rotated about a desired amount around the vertical axis 72*a*. Stops which limit the rotation are internally present in the rotational drive and therefore they have not to be provided separately.

With the lower side of the flange 114, a gearwheel 144 is splinedly connected, which meshes with a sprocket (not shown) which drives a not shown potentiometer. Thus, the respective turning position of the lifting mast 70 or the lifting cylinder 72 can be determined with the aid of such an arrangement.

Figure 4:
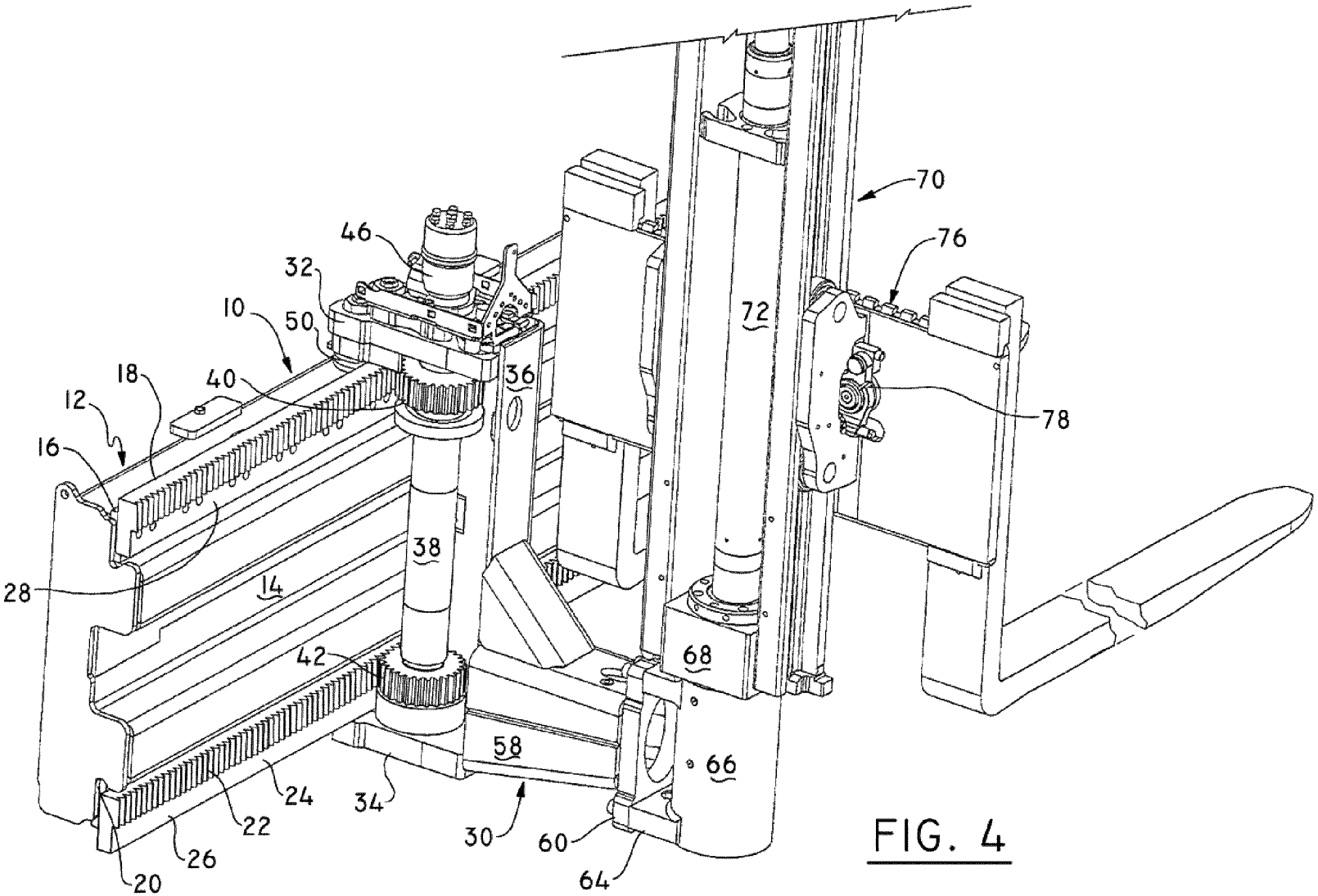
FIG. 4 shows a perspective view of the side push frame with side arm for a three-side stacker shown in FIG. 1.
Figure 5:
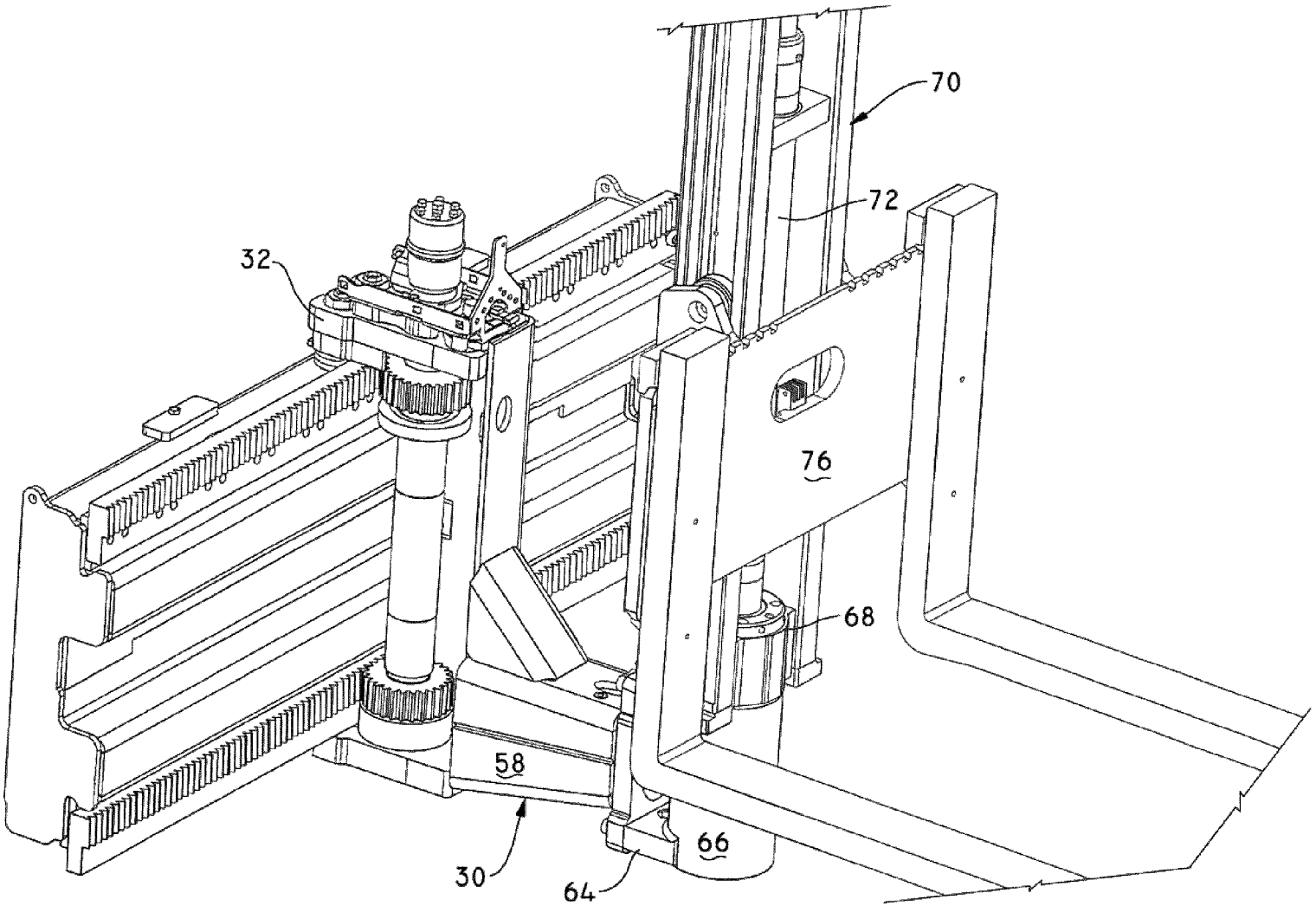
FIG. 5 shows a perspective view of the side push frame with side arm shown in FIG. 4 with the fork rotated 90 degrees.
Figure 6:
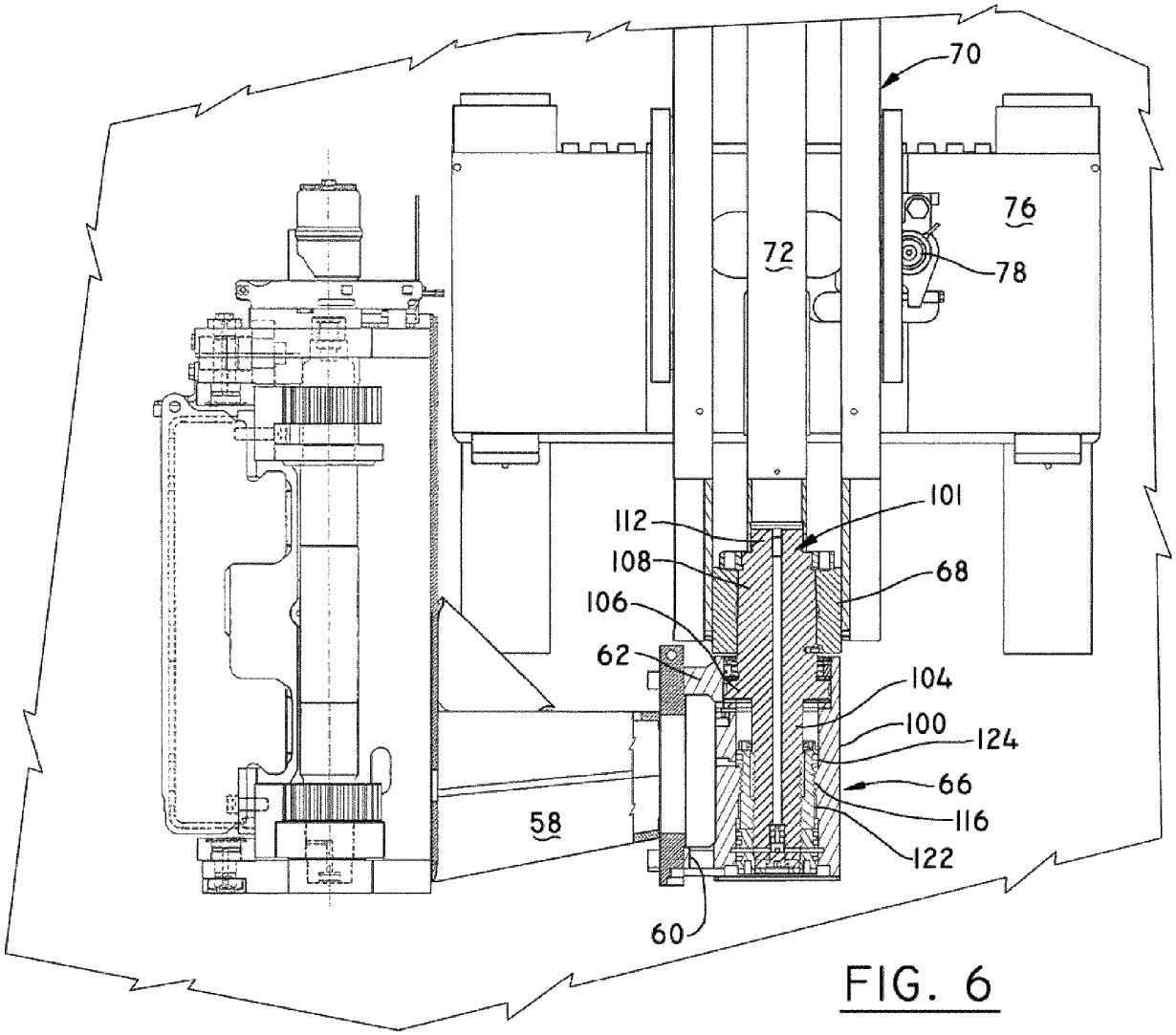
FIG. 6 shows a cross-sectional view of the embodiment shown in FIG. 4.
Figure 7:
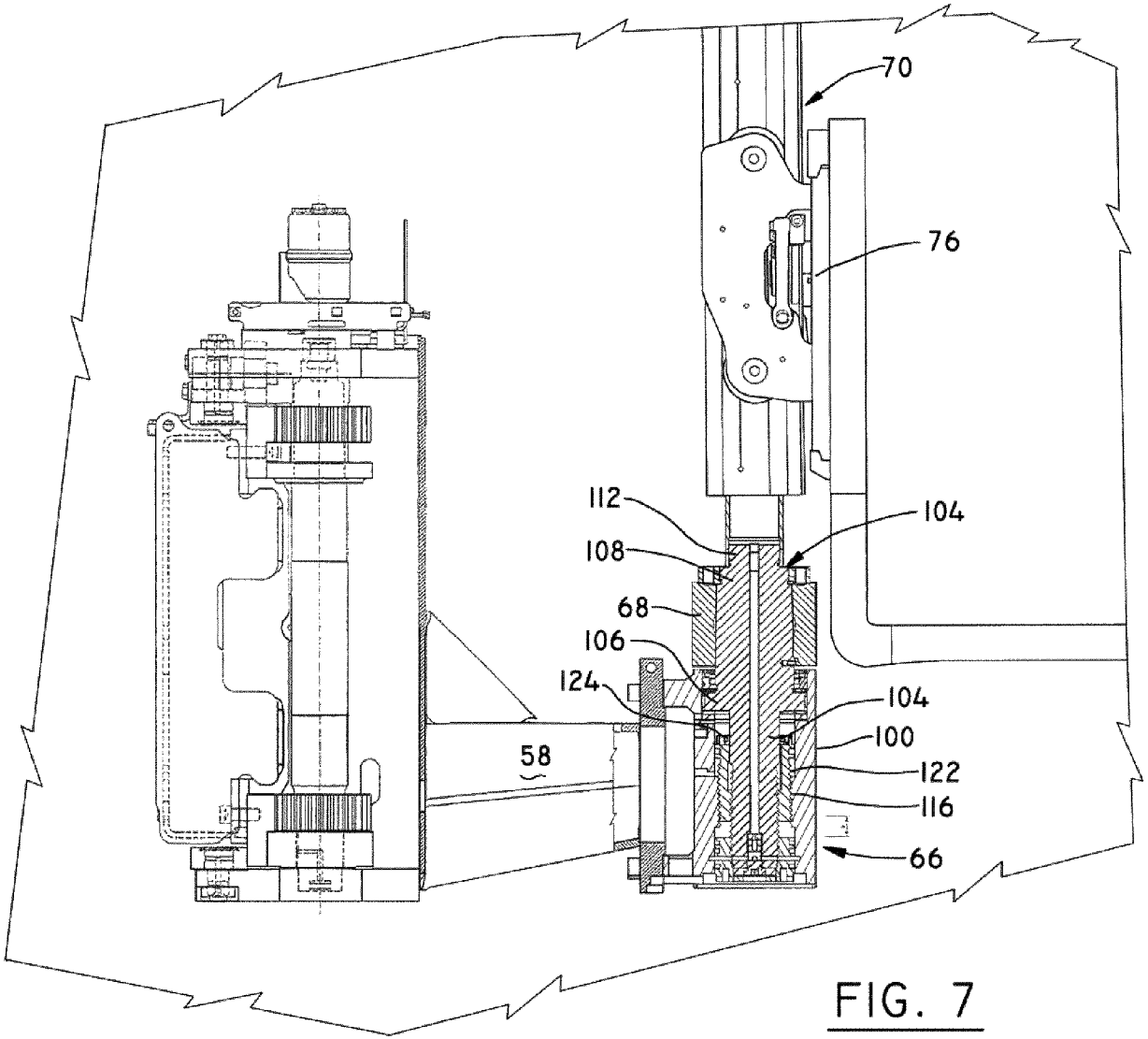
FIG. 7 shows a cross-sectional view of the embodiment shown in FIG. 5.

FIGS. 4 and 5 each show a perspective view of an embodiment of the invention as shown in FIG. 1. FIG. 5 shows the fork carrier 76 rotated 90 degrees from its position in FIG. 4. FIGS. 6 and 7 show a cross sectional view of the embodiment as shown in FIGS. 4 and 5, respectively. Here, the actuation of mast 70 as described above can be seen. The sleeve 122 has an inner and outer thread. The outer thread engages a thread of the casing bore 116, and the inner thread engages a thread of spindle 101. The spindle 101 through portion 112 engages a member 68, which in turn is rotationally fixed with respect to mast 70. A plunger 124 is connected with sleeve 122. If plunger 124 is moved upwardly or downwardly, the sleeve is rotated accordingly and drives spindle 101 rotationally. Thus, mast 70 is rotated as desired. This is described in the specification at pages 7-8, and no new matter has been introduced.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

What is claimed is:

1. A three-side stacker comprising a side push frame at one end of the stacker, on which a side arm is horizontally traversable mounted, wherein the side arm has a first traversable portion mounted on the side push frame and a second portion, which is mounted pivotally around a vertical axis on the first portion and on which a load supporting means is mounted, which is actuable by a hydraulic driving means having a hydraulic lifting cylinder, and a pivoting equipment for the second portion, mounted on the first portion, the driving means being attached to a lifting mast for the load supporting means, further comprising a casing (100) for the hydraulic drive means (66) having a rotary spindle (101) attached to the first portion, a portion of the spindle (101) outside of casing (100) being attached to the lifting mast (70), which portion supporting the lifting mast, and in that further the hydraulic drive means (66) is defined as a rotary feedthrough for a conduit for hydraulic medium for the lifting cylinder (72) at the second portion, a passage (140) of spindle (101) being connected with a stationary terminal for hydraulic medium in each position of the spindle and the axial passage (140) being connected to lifting cylinder (72).

2. A three side stacker according to claim 1, further comprising the spindle of the rotational drive (66) is actuable by a threaded sleeve (122), which is in turn actuable by a plunger (124) which is guided in the casing (100) of the hydraulic drive means (66), and the channel (140) in the spindle (101) is connected with at least one radial channel (138) in a flange (114), connected with the spindle, which is sealingly and rotatably mounted in the casing (100), wherein the radial channel (138) is aligned with an annular channel (136) on the inner side of the casing (100), which is in connection with the outer hook-up (130) for the hydraulic medium on the casing (100) via bore portions (132, 134).

3. A three side stacker according to claim 1, further comprising a bottom part (112) for the lifting cylinder (72) is connected with the free end of the spindle, on which the envelope of the lifting cylinder (72) is sealingly supported.

4. A three side stacker according to claim 1, further comprising a lifting mast (70) is fixed on a spigot-shaped portion (108), connected with the spindle.

5. A three side stacker according to claim 1, further comprising a transmitter (144) is connected with the spindle (101), and an angle sensor, reacting to the transmitter, is arranged in the casing (100).

6. A three side stacker according to claim 5, further comprising a gearwheel (144) sits on the spindle, which actuates a potentiometer via a sprocket.

7. A three-side stacker, comprising:

a stacker;

a side push frame at one end of the stacker;

a side arm horizontally traversably mounted to the side push frame, the side arm having a first traversable portion mounted on the side push frame and a second portion which is mounted pivotally around a vertical axis on the first portion;

a load supporting device, which is mounted on the second portion and which is actuable by a hydraulic drive (66), the hydraulic drive being attached to the lifting mast for the load supporting device;

a pivoting device for the second portion, the pivoting device mounted on the first portion;

further comprising that the load supporting device is actuable by a hydraulic lifting cylinder;

a casing (100) for the hydraulic drive (66) having a rotary spindle (101) attached to the first portion, a portion of the spindle (101) outside of casing (100) being attached to the lifting mast, the portion supporting the lifting mast, and further in that the hydraulic drive (66) is defined as a rotary feedthrough for a conduit for hydraulic medium for the lifting cylinder (72) at the second portion, a passage (140) of spindle (101) being connected with a stationary terminal for hydraulic medium in each position of the spindle and the axial passage (140) being connected to lifting cylinder (72).

* * * * *